US012320089B2

(12) United States Patent
Putnam et al.

(10) Patent No.: US 12,320,089 B2
(45) Date of Patent: Jun. 3, 2025

(54) REINFORCED MANHOLE COVER GASKET

(71) Applicant: Sewer Sentry LLC, Calhoun, LA (US)

(72) Inventors: William Eugene Putnam, West Monroe, LA (US); Randall Avery Putnam, West Monroe, LA (US); David Alan Putnam, West Monroe, LA (US); Mark Alfred Weih, San Jose (CR); Guido Quesada, San Jose (CR)

(73) Assignee: Sewer Sentry LLC, Calhoun, LA (US)

( * ) Notice: Subject to any disclaimer, the term of this patent is extended or adjusted under 35 U.S.C. 154(b) by 726 days.

(21) Appl. No.: 17/472,274

(22) Filed: Sep. 10, 2021

(65) Prior Publication Data

US 2022/0081869 A1 Mar. 17, 2022

Related U.S. Application Data

(60) Provisional application No. 63/077,356, filed on Sep. 11, 2020.

(51) Int. Cl.
*E02D 29/14* (2006.01)

(52) U.S. Cl.
CPC ..... *E02D 29/149* (2013.01)

(58) Field of Classification Search
CPC ..... E02D 29/149; E02D 29/14
See application file for complete search history.

(56) References Cited

U.S. PATENT DOCUMENTS

| | | | |
|---|---|---|---|
| 193,605 | A | 7/1877 | Hay |
| 574,992 | A | 1/1897 | Held |
| 576,253 | A | 2/1897 | Bingham |
| 1,469,790 | A | 10/1923 | Hysko |
| 2,009,132 | A | 7/1935 | Gehris |
| 2,026,788 | A | 1/1936 | Kirby |
| 3,530,882 | A | 9/1970 | Case et al. |
| 3,712,009 | A | 1/1973 | Campagna |
| 3,798,848 | A | 3/1974 | Campagna |
| 3,920,347 | A | 11/1975 | Sauriol et al. |
| 3,953,554 | A | 4/1976 | Loughridge |

(Continued)

FOREIGN PATENT DOCUMENTS

| | | |
|---|---|---|
| DE | 69 44 309 U | 6/1970 |
| DE | 36 37 493 A1 | 5/1988 |

(Continued)

OTHER PUBLICATIONS

International Search Report and Written Opinion for International Patent Application No. PCT/US2021/049918 dated Dec. 22, 2021.

(Continued)

*Primary Examiner* — Abigail A Risic
(74) *Attorney, Agent, or Firm* — Foley & Lardner LLP

(57) ABSTRACT

A reinforced gasket for sealing a manhole, the gasket comprising a reinforcement ring having an upper surface and a generally planar lower surface; and a sealing assembly comprising a first ring and a second ring with an intermediate member extending between the first ring and the second ring, the intermediate member defining a contact surface; wherein the reinforcement ring is disposed between the first ring and the second ring of the sealing assembly such that the upper surface of the reinforcement ring is in contact with the contact surface of the seal ring.

20 Claims, 4 Drawing Sheets

(56) References Cited

U.S. PATENT DOCUMENTS

| | | | | |
|---|---|---|---|---|
| 3,973,856 | A | 8/1976 | Gaglioti | |
| 4,067,659 | A | 1/1978 | Campagna et al. | |
| 4,069,840 | A | 1/1978 | Brown et al. | |
| 4,103,901 | A * | 8/1978 | Ditcher | F16L 5/10 277/606 |
| 4,305,679 | A | 12/1981 | Modi | |
| 4,440,407 | A * | 4/1984 | Gagas | F16J 15/106 52/19 |
| 4,475,571 | A | 10/1984 | Houston, Jr. et al. | |
| 4,501,292 | A | 2/1985 | Maloblocki | |
| 4,512,492 | A | 4/1985 | Graybeal | |
| 4,586,941 | A | 5/1986 | Cooley | |
| 4,597,692 | A | 7/1986 | Gruenwald | |
| 4,650,365 | A | 3/1987 | Runnels | |
| 4,687,023 | A | 8/1987 | Harbison et al. | |
| 4,762,440 | A | 8/1988 | Argandona | |
| 4,768,675 | A | 9/1988 | Coleman | |
| 4,834,574 | A * | 5/1989 | Bowman | E02D 29/14 404/26 |
| 4,919,564 | A | 4/1990 | Neathery et al. | |
| 5,062,735 | A | 11/1991 | Gaudin | |
| 5,401,114 | A | 3/1995 | Guggemos | |
| 5,727,351 | A | 3/1998 | Neathery et al. | |
| 5,846,274 | A | 12/1998 | Smelser | |
| 5,924,846 | A | 7/1999 | Arnold et al. | |
| 6,161,984 | A * | 12/2000 | Sinclair | E02D 29/1427 404/25 |
| 6,510,869 | B1 | 1/2003 | Ouchi et al. | |
| 6,514,008 | B1 * | 2/2003 | Smolnik | E02D 29/16 405/26 |
| 6,616,370 | B1 | 9/2003 | Signorelli | |
| 6,848,465 | B1 | 2/2005 | Ledbetter | |
| 7,798,742 | B2 | 9/2010 | Nolle et al. | |
| 7,849,617 | B2 | 12/2010 | Intagliata et al. | |
| 7,883,290 | B1 | 2/2011 | Ross et al. | |
| 8,851,789 | B2 | 10/2014 | Bax | |
| 8,851,791 | B1 | 10/2014 | Putnam | |
| 9,091,367 | B2 | 7/2015 | Waldor | |
| 9,605,403 | B1 | 3/2017 | Putnam | |
| 9,695,569 | B1 | 7/2017 | Knowles | |
| 9,784,650 | B1 | 10/2017 | Neathery | |
| 11,118,323 | B1 | 9/2021 | Putnam | |
| 11,536,003 | B1 * | 12/2022 | Forlong | B05D 1/26 |
| 2008/0105306 | A1 | 5/2008 | Takai | |
| 2009/0223574 | A1 | 9/2009 | Montague | |
| 2012/0048401 | A1 | 3/2012 | Yamashita et al. | |
| 2012/0227168 | A1 | 9/2012 | Paoluccio et al. | |
| 2013/0089373 | A1 | 4/2013 | Bax | |
| 2014/0137949 | A1 | 5/2014 | Montague | |
| 2016/0356522 | A1 | 12/2016 | Bertini et al. | |
| 2022/0112678 | A1 | 4/2022 | Putnam | |
| 2023/0265637 | A1 | 8/2023 | Putnam | |

FOREIGN PATENT DOCUMENTS

| | | | |
|---|---|---|---|
| DE | 10 2006 054 343 | B3 | 1/2008 |
| DE | 10 2006 045 873 | A1 | 4/2008 |
| EP | 1 655 416 | A2 | 5/2006 |
| KR | 20110093249 | A | 8/2011 |
| WO | WO-92/09753 | A1 | 6/1992 |
| WO | WO-2018/143963 | | 8/2018 |

OTHER PUBLICATIONS

Gromicko, Nick and Will Decker. "Standpipes." NAHI, InterNACHI, Aug. 22, 2010. Web. https//www.nachi.org/standpipes.htm.

International Search Report dated Apr. 28, 2017 in PCT/US2017/15908, 3 pages.

International Search Report and Written Opinion for International Patent Application No. PCT/US2021/054279 dated Jan. 19, 2022.

International Search Report and Written Opinion for International Patent Application PCT/US22/53535 dated May 25, 2023.

Stainless Steel Sanitary Tubing—5 Foot Lengths. Datasheet [online], Buy Fittings Online, Oct. 6-7, 25, 2021 [retrieved Mar. 17, 2023]. Entire Document. Retrieved from the Internet: https://www.buyfittingsonline.com/stainless-steel-sanitary-tubing-5-ft-length-pre-cut/.

International Search Report and Written Opinion in PCT/US2024/027031 dated Aug. 28, 2024.

Extended European Search Report on EP Patent Application No. 21880825.1 dtd Oct. 22, 2024, 12 pgs.

* cited by examiner

REINFORCED MANHOLE COVER GASKET

CROSS REFERENCE TO RELATED APPLICATIONS

This application claims the benefit of and priority to U.S. Provisional Patent Application No. 63/077,356 filed Sep. 11, 2020, entitled Reinforced Manhole Cover Gasket, the entire contents of which are incorporated herein by reference in its entirety.

FIELD

The present invention relates generally to the field of manhole covers, and in particular, manhole cover gaskets, and even further, reinforced manhole cover gaskets.

BACKGROUND

Manholes provide physical access to underground sewer systems. Easy manhole access is vital for utility company personnel to be able to access utility lines that are located underground. Manholes typically consist of a structural sleeve that provides the opening of the manhole and are closed by placing a large, heavy cover within the opening. Manholes oftentimes contain a gasket that provides a seal between the manhole sleeve and the cover, which functions to prevent rainwater and other fluid and debris from intruding into the sewer system and to prevent unpleasant sewer gases from escaping above ground.

Current gasket technology uses simple, flat rubber gaskets that are cumbersome to install and in use, are unable to withstand mechanical forces. Gaskets are oftentimes held in place on a shoulder within the manhole sleeve with an adhesive. Very strong adhesives are used, which complicates installation and makes removal of a failed gasket a difficult and costly process. There is a need for a strong gasket that is able to provide a seal for a sewer manhole without the need for a cumbersome and costly adhesive.

SUMMARY OF THE INVENTION

According to a first embodiment, there is provided a reinforced gasket for use in sealing a sewer manhole that can be installed in the manhole sleeve without the need for adhesive. According to embodiments disclosed herein, inner and outer seal rings are joined by an intermediate segment, the assembly being supported in a generally rigid fashion by a reinforcing ring. The shape of the reinforced gasket provides two compression points that produce a seal between the manhole cover and sleeve. Additionally, when compressed, the outer portion of the gasket contacts and seals with the inner walls of manhole sleeve, thus reducing and/or substantially eliminating lateral movement of the manhole cover due to vehicles contacting and passing over the manhole.

According to a second embodiment, there is provided a method for sealing a manhole. The method includes providing a manhole sleeve having a shoulder, a cover, and a reinforced gasket. The method further includes placing the reinforced gasket onto the shoulder and covering the manhole opening by placing the manhole cover into the manhole sleeve atop the reinforced gasket to thereby create a seal between the cover and the manhole sleeve.

According to a third embodiment, there is provided a manhole in a sewer system. In this embodiment, a manhole sleeve is provided at an opening for a sewer, which includes a shoulder for placing a manhole cover. A reinforced gasket contains a reinforcing ring disposed between inner and outer sealing rings on the shoulder. A manhole cover is placed within the sleeve atop the reinforced gasket. The weight of the manhole cover presses the gasket against the shoulder, creating two seal points between the shoulder and the manhole cover.

BRIEF DESCRIPTION OF THE DRAWINGS

The accompanying drawings facilitate an understanding of the various embodiments.

Like reference numerals indicate like elements.

DETAILED DESCRIPTION

Manholes are typically used to provide personnel physical access to sewer systems through an opening. Manhole sleeves provide mechanical stability to the opening and manhole covers are placed in and supported by the manhole sleeves to prevent accidental falls and to discourage unauthorized access to the sewers through the manhole openings. A seal between the manhole sleeve and the cover is oftentimes used to prevent rainwater and other fluids and debris from intruding into the sewer system while also preventing and/or substantially reducing unpleasant sewer gases from escaping. A reinforced gasket to seal manholes is disclosed herein.

Figure 1:
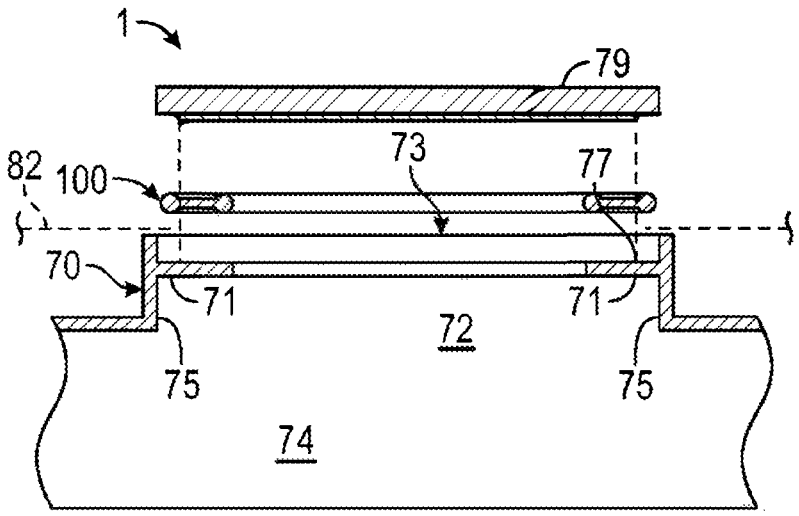
FIG. 1 is an exploded, cross section view of a manhole sleeve with shoulders, a manhole cover, and a reinforced gasket.
Figure 2:
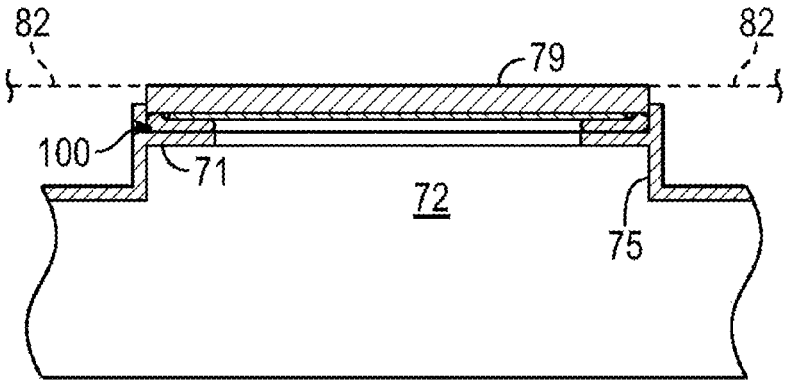
FIG. 2 is a cross section view of the manhole sleeve of FIG. 1 fully assembled.

FIGS. 1 and 2 illustrate a manhole sleeve 70 in which a reinforced gasket 100 is employed to advantage to create a seal between the manhole sleeve 70 and a manhole cover 1 positioned in a manhole opening 72, which communicates with a sewer 74. In the embodiment illustrated in FIGS. 1 and 2, the manhole sleeve 70 of the manhole opening 72 is positioned below a ground surface 82, such as a road or sidewalk, and includes an opening 73 to facilitate ingress and egress therethrough to/from the sewer 74. The manhole sleeve 70 further includes a shoulder 71 extending radially inward from an inner wall or a sidewall 75 to provide a surface 77 to support (i) the reinforced gasket 100 and (ii) the manhole cover 1. In the embodiment illustrated in FIGS. 1 and 2, the shoulder 71 is positioned within the manhole sleeve 70 such that when the reinforced gasket 100 is sandwiched between the shoulder 71 and the manhole cover 1, the upper or top surface 79 of the manhole cover 1 is level with the ground surface 82.

During installation, the reinforced gasket 100 is inserted within the manhole sleeve 70 and positioned on the shoulder 71. Once the gasket 100 is positioned and resting on the shoulder 71, the manhole cover 1 is positioned within the manhole sleeve 70 to rest on the reinforced gasket 100. Once installed, the weight of the manhole cover 1 forces the reinforced gasket 100 against the shoulder 71 such that, and as explained in greater detail below, the gasket 100 partially deforms within the manhole sleeve 70 to form a seal between the gasket 100, the manhole cover 1, and the sidewall 75. Embodiments of the gasket 100, as explained in greater detail below, reduce and/or otherwise eliminate the inflow of surface water and other fluids and debris, the passage of odors, and also prevents the manhole cover 1 from shifting back and forth due to contact with motor vehicles as they pass over the manhole cover 1.

Figure 3:
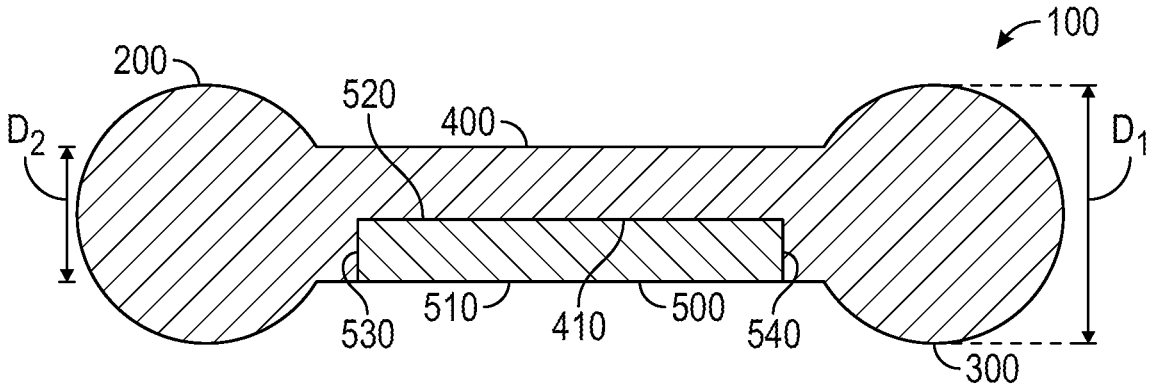
FIG. 3 is a cross section view of the reinforced gasket.
Figure 4:
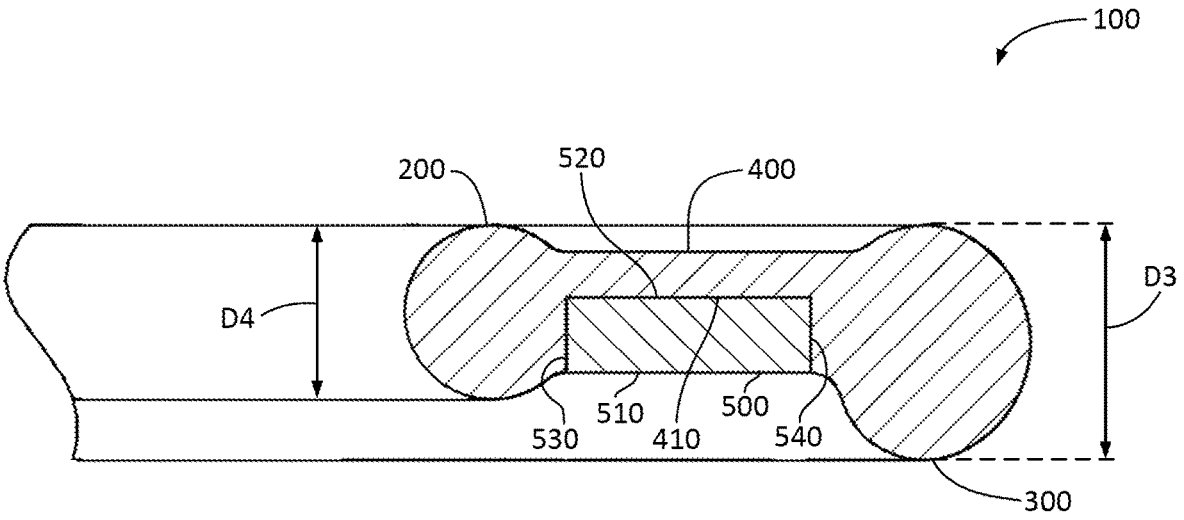
FIG. 4 is a cross section view of another embodiment of a reinforced gasket.

Referring now to FIGS. 3 and 4, the reinforced gasket 100 is formed having a "dog-bone" or "bar-bell" shaped cross section so as to provide two independent seal or pinch points. In the embodiment illustrated in FIG. 3, the reinforced gasket 100 includes an inner ring 200 and an outer ring 300 secured to or otherwise joined by an intermediate segment 400 and a reinforcement or reinforcing ring 500. As previously discussed, the inner and outer rings 200 and 300 each provide a seal effect when the manhole cover 1 is placed atop of the reinforced gasket 100 (FIG. 2). In particular, the outer ring 300 of the gasket 100, when compressed, deforms to abut and otherwise contact with the inner wall 75 of the manhole sleeve 70, creating a seal that reduces intrusion of rainwater and other fluids and debris and also reduces lateral movement of the manhole cover 1 due to the vehicles passing over the cover.

In use, the reinforcing ring 500 is positioned within the gasket 100 to provide additional rigidity to the gasket 100, which allows the gasket 100 to be more easily installed in the manhole sleeve 70 without the need for or reducing the required amount of adhesives to secure the gasket 100 within the manhole. Furthermore, and as mentioned previously, the reinforcing ring 500 allows the gasket 100 to reduce, resist, and/or substantially eliminate lateral shifting of the manhole cover 1 due to vehicle traffic. In use, if one seal ring 200 or 300 fails or becomes worn or damaged, the remaining functioning seal ring 200 or 300 will continue to seal so as to, among other functions, reduce the rainwater intrusion and prevent sewer gases from escaping through the opening 73.

According to some embodiments, the inner ring 200, the outer ring 300, and the intermediate segment 400 are formed of a rubber, plastic, fluoropolymer, metal or any other semi-rigid or rigid material. For example, in one embodiment, the inner and outer rings 200 and 300 and the intermediate segment 400 are formed of a fluoropolymer; however, it should be understood that other materials or combination of materials may be used. In another embodiment, the inner ring 200 may be formed of rubber, the outer ring 300 may be formed of a copper alloy, and the intermediate segment 400 may be formed of a soft plastic material.

According to embodiments disclosed herein, the reinforcing ring 500 may be formed of plastic, metal, or any other structurally suitable material having a sufficient stiffness or rigidity to allow the gasket 100 to maintain its generally circular shape (or other predetermined shape) to provide an effective seal. For example, the reinforcing ring 500 may be formed of a material having sufficient rigidity to prevent the gasket 100 from folding up and falling inside or through the opening 73. In one embodiment, the reinforcing ring 500 is formed of steel. In another embodiment, the reinforcing ring 500 is formed of a rigid acrylic plastic.

It should be understood that while embodiments illustrated herein include inner and outer rings 200 and 300 each having a generally circular cross section, other cross sectional shapes may be used. For example, the cross section of the inner ring 200 and the outer ring 300 may be ovoid or polygonal. For example, in the embodiment illustrated in FIG. 4, the cross sectional shape of the outer ring 300 is ovoid. In another embodiment, for example, the cross sectional shape of the inner ring 200 and the outer ring 300 are both octagonal so as to present a planar face to the manhole sleeve shoulder 71 and the manhole cover 1. In other embodiments, the cross sectional shape of the inner ring 200 is different from the outer ring 300. For example, in the embodiment illustrated in FIG. 4, the cross sectional shape of the inner ring 200 is generally circular and the cross sectional shape of the outer ring 300 is generally ovoid.

With renewed reference to FIG. 3, the diameter/height D1 of the inner ring 200 and the diameter/height D1 of the outer ring 300 are greater than the combined thickness of the intermediate segment 400 and the reinforcing ring or the structural ring 500 D2. This allows the inner ring 200 and the outer ring 300 to be compressed under the weight of the manhole cover 1 to form a comfortable seal. The cross-sectional diameter/height of the inner and outer rings 200 and 300 may be larger or smaller relative to the combined thickness of the intermediate segment 400 and the reinforcement ring 500 depending on the material used for the gasket 100. For example, in one embodiment, the inner ring 200 and the outer ring 300 are formed of a soft fluoropolymer material. In this embodiment, the diameter/height of the inner ring 200 and the outer ring 300 are larger with respect to the thickness of the intermediate segment 400 and the reinforcing ring 500 so as to effectively create the seal when the manhole cover 1 is set on the reinforced gasket 100. This accommodates the softer and thus greater compression of the material of the inner and outer rings 200 and 300.

In the embodiment illustrated in FIG. 4, a cross-sectional diameter/height D3 of the outer ring 300 and a cross-sectional diameter/height D4 of the inner ring 200 are not equal. For example, diameter/height D3 of the outer ring 300 may be larger than the diameter/height D4 of the inner ring 200. Such embodiment provides a greater sealing surface between the gasket 100, the shoulder 71, the sidewall 75, and the manhole cover 1 when the gasket 100 partially deforms within the manhole sleeve 70 to form a seal therein. In other embodiments, the diameter/height D3 of the outer ring 300 may be the same or smaller than the diameter/height D4 of the inner ring 200.

With the continued reference to FIGS. 3 and 4, in the illustrated embodiments, the reinforcing ring 500 is formed having a pair of sidewalls 530 and 540, a bottom wall 510 and a top wall 520 forming a rectangular cross section. However, it should be understood that the cross section of the reinforcing ring 500 may be otherwise formed. For example in addition to a rectangular cross section, cross-sectional shapes may include, but are not limited to, circular, triangular, polygonal, oval and semi-circular, or the like.

In the embodiments illustrated in FIGS. 3 and 4, the bottom wall 410 of the intermediate segment 400 is planar and sized to receive and otherwise contact a corresponding top wall 520 of the reinforcing ring 500. It should be understood that the surfaces may be otherwise shaped. For example, according to another embodiment, the upper surface 520 is concave and the bottom wall 410 is convex.

Figure 5:
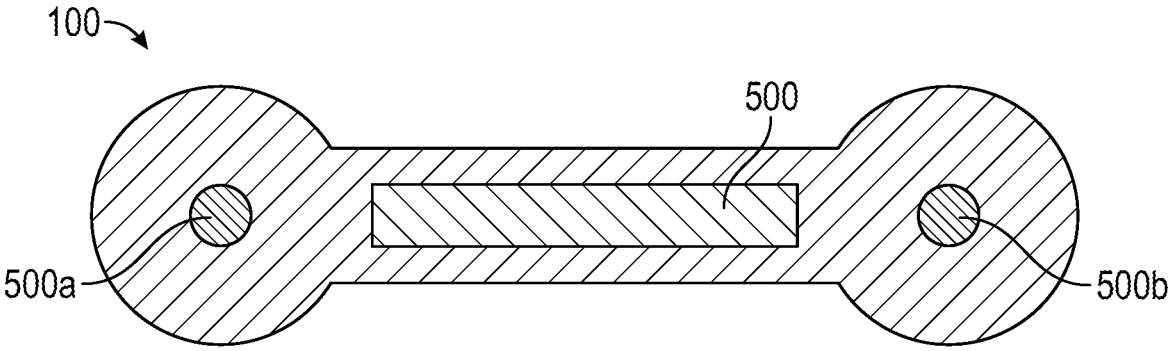
FIG. 5 is a cross section view of yet another embodiment of a reinforced gasket.

According to some embodiments, the inner ring 200, the outer ring 300 and the intermediate segment 400 are molded or otherwise formed as a single unitary component. The reinforcing ring 500 can be secured to the intermediate segment 400 and/or the inner and outer rings 200 and 300 by an adhesive. In other embodiments, the inner ring 200, outer ring 300, and the intermediate segment 400 can be molded onto and around the reinforcement ring 500, as illustrated for example, in FIG. 5. With continued reference to FIG. 5, the reinforcement ring 500 is disposed within the gasket 100 so as to be completely encapsulated therein. In addition to or in lieu of the reinforcement ring 500 being disposed therein, one or more reinforcement rings 500*a* and 500*b* are disposed within the inner and outer rings 200 and 300, respectively. As illustrated, the reinforcement rings 500*a* and 500*b* contain a circular cross section; however, it should be understood that other cross sectional shapes of the reinforcement rings 500*a* and 500*b* or combination of such shapes may be used.

Unless otherwise indicated, all numbers expressing quantities of properties, parameters, conditions, and so forth, used in the specification and claims are to be understood as being modified in all instances by the terms "about," "approximately," and "substantially." Accordingly, unless indicated to the contrary, the numerical parameters set forth in the following specification and attached claims are approximations. Any numerical parameter should at least be construed in light of the number reported significant digits and by applying ordinary rounding techniques. The terms "about," "approximately," and "substantially," when used before a numerical designation, e.g., angles, measurements, amounts, and ratios, indicates approximations which may vary by (+) or (−) 10%, 5% or 1%.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures.

In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A reinforced gasket for sealing a manhole comprising:

an annular seal having an inner ring and an outer ring, and an intermediate segment extending between the inner and outer rings, the inner and outer rings formed having a height greater than a height of the intermediate segment; and a reinforcement ring having a stiffness value that is greater than a stiffness value of the annular seal and a height that is less than the height of the inner and outer rings, the reinforcement ring secured to the annular seal to increase a stiffness of the reinforced gasket.

2. The reinforced gasket of claim 1, wherein the inner ring has a circular cross section having a first diameter and the outer ring has a circular cross section with a second diameter.

3. The reinforced gasket of claim 2, wherein the first and second diameters are greater than a thickness of the intermediate segment.

4. The reinforced gasket of claim 1, wherein the reinforcement ring is secured to an external surface of the annular seal.

5. The reinforced gasket of claim 1, wherein the reinforcement ring is embedded within the annular seal.

6. The reinforced gasket of claim 1, wherein the reinforcement ring is in at least one of the inner ring or the outer ring.

7. The reinforced gasket of claim 1, wherein the reinforcement ring is formed of metal.

8. The reinforced gasket of claim 1, wherein the reinforcement ring is formed of plastic.

9. The reinforced gasket of claim 1, wherein a height of the outer ring is greater than a height of the inner ring.

10. A method for sealing a manhole, the method comprising:

providing a manhole sleeve forming an opening, the manhole sleeve including a shoulder radially extending inwardly;

providing a manhole cover for insertion within the manhole sleeve to enclose the opening;

providing a reinforced gasket with a gasket height, the reinforced gasket formed having a reinforcing member to increase a stiffness of the reinforced gasket and having a height that is less than the gasket height;

positioning the reinforced gasket on the shoulder; and placing the manhole cover into the manhole sleeve, the manhole cover positioned to exert a compression force to deform the reinforced gasket to seal the manhole.

11. The method of claim 10 wherein providing the reinforced gasket comprises:

forming a first ring and a second ring with an intermediate segment extending between the first ring and the second ring.

12. The method of claim 11, further comprising securing a reinforcement ring to at least one of the first ring, the second ring, or the intermediate segment.

13. The method of claim 12, wherein the securing the reinforcement ring comprises securing the reinforcement ring to an outer surface of the intermediate segment.

14. A system for sealing a manhole comprising:

a manhole sleeve having an inner wall defining an opening;

a shoulder extending into the opening from the inner wall of the manhole sleeve;

a gasket having a height and comprising a reinforcement ring to increase a stiffness of the gasket and having a height that is less than the gasket height; and a manhole cover disposed within the manhole sleeve and positioned to sandwich the gasket between the manhole cover and the shoulder such that the manhole cover presses the gasket against the shoulder thereby creating a first seal between the gasket and the shoulder and a second seal between the gasket and the manhole cover and a third seal between the gasket and the manhole sleeve.

15. The system of claim 14 wherein the gasket further comprises:

a first ring and a second ring with an intermediate segment extending between the first ring and the second ring, the intermediate segment defining a contact surface; and wherein the reinforcement ring is joined to the contact surface.

16. The system of claim 14 wherein the first ring has a circular cross section having a first diameter and the second ring has a circular cross section having a second diameter.

17. The system of claim 14, wherein the reinforcement ring is disposed within the gasket.

18. The system of claim 14, wherein the reinforcement ring is made of a metal material.

19. The system of claim 14, wherein the reinforcement ring is made of a plastic material having a stiffness greater than the stiffness of the gasket.

20. The system of claim 14, wherein the reinforcement ring is disposed within the at least one of the first ring or the second ring.

* * * * *